United States Patent [19]

Rowe

[11] 3,973,257

[45] Aug. 3, 1976

[54] APPARATUS FOR DETECTING CHANGES IN THE ELECTRICAL CHARACTERISTICS OF SENSOR DEVICES

[75] Inventor: Anthony William Rowe, Southampton, England

[73] Assignee: Dreamland Electrical Appliances Limited, England

[22] Filed: Jan. 23, 1975

[21] Appl. No.: 543,311

[30] Foreign Application Priority Data

Jan. 29, 1974 United Kingdom ..... 4040/74

[52] U.S. Cl. ..... 340/418; 340/227 R; 340/248 E; 340/421

[51] Int. Cl.[2] ..... G08B 19/00

[58] Field of Search ..... 340/146.1 BE, 248 R, 340/248 E, 288, 292, 418, 421, 412, 409, 227 R, 227 C, 228 R

[56] References Cited

UNITED STATES PATENTS 3,686,531 8/1972 Decker et al. ..... 340/248 R X 3,829,849 8/1974 Stauffer ..... 340/248 E

*Primary Examiner*—Alvin H. Waring

*Attorney, Agent, or Firm*—Fleit & Jacobson

[57] ABSTRACT

The invention relates to electrical apparatus for detecting a change in the electrical characteristics of a sensor device, such as a device for sensing fire, the apparatus comprising a plurality of electrical circuits arranged in parallel and connected to an output circuit which can activate or initiate operation of a device which is required to be operated when the electrical characteristics of the sensor device change, each parallel circuit being provided with means for automatically indicating that the circuit is functioning correctly, any fault in the circuit being automatically indicated and the circuit preventing the output circuit from activating or initiating operation of said device due to a fault.

5 Claims, 2 Drawing Figures

APPARATUS FOR DETECTING CHANGES IN THE ELECTRICAL CHARACTERISTICS OF SENSOR DEVICES

BACKGROUND OF THE INVENTION

A sensor device is known in which its electrical characteristics change with a change of temperature. In the construction of electrically heatable blankets it has been known to provide an electrical resistance heating element which had an insulation which incorporated a layer of sensor material having a negative temperature coefficient of electrical impedance and this was used as part of a safety cut-out control system to prevent overheating of the blanket. I have taken this device and have used it as a fire detecting means. For example the device, which may be in the form of a wire or cable, can be positioned at suitable locations to detect fire. It may for example be run along and lie adjacent to electrical power transmitting cables in a power station or the like to sense any overheating of the power transmitting cables. In order to be able to use such a device as a fire detecting device I have now devised the detecting apparatus which detects any change in the electrical characteristics of the sensor device.

SUMMARY OF THE INVENTION

This invention relates generally as indicated to detecting apparatus and particularly apparatus for detecting a change in the electrical characteristics of a sensor device. The detecting apparatus may comprise apparatus for detecting fire or overheating conditions.

An object of the invention is to provide detecting apparatus which will detect a change in the electrical characteristics of the sensor device.

Another object is to provide a detecting apparatus which will automatically give an indication that the detecting apparatus is working satisfactory and will automatically give an indication of any fault in the apparatus.

According to the present invention there is provided apparatus for detecting a change in the electrical characteristics of a sensor device, comprising a plurality of electrical circuits arranged in parallel and connected to an output circuit which can activate or initiate operation of a device which is required to be operated when the electrical characteristic of the sensor device change, each of said parallel electrical circuits being electrically connectable to a sensor device and operative to cause said output circuit to activate or initiate operation of said device when the electrical characteristics of the sensor device change and each parallel circuit being provided with means for automatically indicating that the circuit is functioning correctly, any fault arising in said circuit being automatically indicated and said circuit preventing the output circuit from activating or initiating operation of said device due to the fault.

Preferably when one of said electrical circuits has a fault therein the other of said parallel circuits remain functional to detect a change in the electrical characteristics of the sensor device and remain operative to cause said output circuit to activate or initiate operation of said device when the electrical characteristics of the sensor device change.

The sensor device preferably is a flexible thermosensitive structure incorporating a layer of sensor material having a negative temperature coefficient of electrical impedance.

Each of said parallel circuits comprises an A.C. generator connected in series with a sensor circuit, part of said sensor circuit being connectable in a shunt relationship with a sensor device whose change in electrical characteristics will cause a change in output from the sensor circuit, said sensor circuit being connected to an A.C. amplifier whose output is connected to an A.C./D.C. converter the output of which is connected to the output circuit and to an indicator means.

The output circuit may comprise a relay which will only drop out when the output from all of the circuits connected thereto fall below a predetermined value.

BRIEF DESCRIPTION OF THE DRAWINGS

To the accomplishment of the foregoing and related ends, the invention then comprises the features hereafter fully described and particularly pointed out in the claims, the following description and annexed drawings setting forth in detail a certain illustrative embodiment of the invention, this being indicative however of but one way in which the principle of the invention may be employed.

In said annexed drawings.

DESCRIPTION OF THE PREFERRED EMBODIMENT

Figure 1:
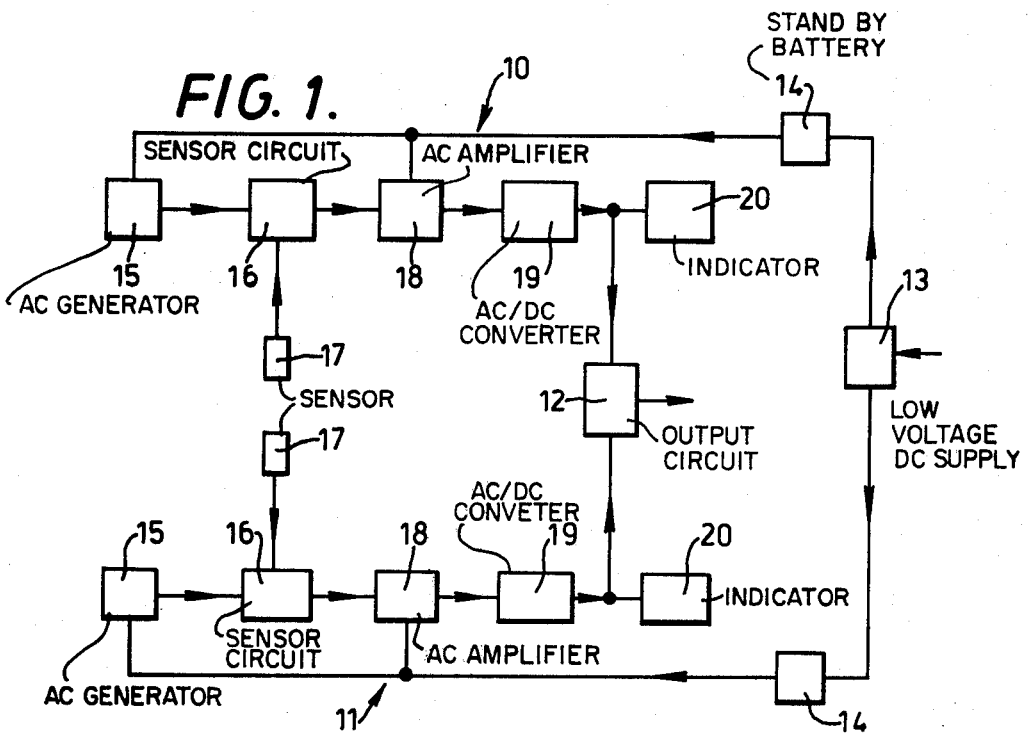
FIG. 1 is a diagrammatic block diagram of a two parallel circuit arrangement.

The detecting apparatus shown in FIG. 1 comprises two electrical circuits 10 and 11 arranged in parallel and connected to an output circuit 12. Each circuit 10, 11 is connected to an A.C. mains voltage supply via a low voltage D.C. supply 13. The low voltage D.C. supply may be provided from stand-by batteries 14 in the event of failure of the A.C. mains voltage supply. The circuits 10 and 11 are identical and therefore only the circuit 10 will be described in detail. The circuit 10 comprises an A.C. generator 15 connected in series with a sensor circuit 16 part of which is connected in a shunt relationship with a sensor 17 and the output of the sensor circuit 16 will change with any change in the electrical characteristics of the sensor 17. The sensor 17 is of a type whose electrical characteristics will change in response to changes in temperature and therefore can be used to detect fire or overheating conditions. The sensor circuit 16 is connected to an A.C. amplifier 18 whose output is fed to an A.C./D.C. converter 19 whose output is fed to an indicator 20 which may consist of a lamp. The output from the converter 19 is also fed to the output circuit 12 which may comprise a relay connected to a visual or audible alarm system (not shown). The output circuit 12 may be connected to means (not shown) for initiating or operating protection means required to be operated upon the electrical characteristics of the sensor being changed, such as fire fighting means (water sprinkler system) where the sensor is used to detect fire or overheating conditions.

The output circuit 12 is designed to give an output only when both circuits have achieved a predetermined state.

Figure 2:
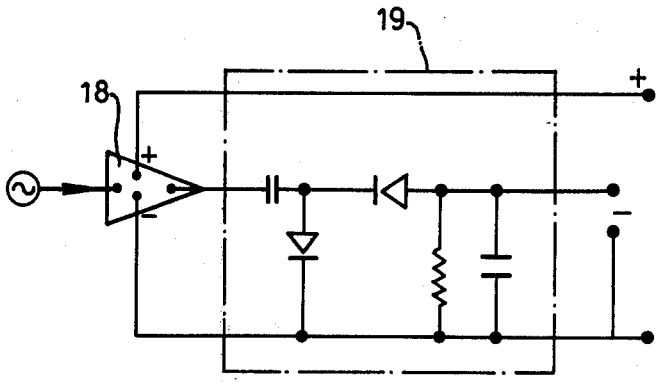
FIG. 2 is a circuit diagram of a suitable A.C. amplifier and A.C./D.C. converter for use in the circuit shown in FIG. 1.

The A.C. amplifier 18 and the A.C./D.C. converter 19 are preferably as shown in FIG. 2. The A.C. amplifier 18 and the A.C./D.C. converter 19 are connected in such a manner that any fault developed in the circuit will cause a reduction in output voltage from the A.C./D.C. converter 19. The A.C. amplifier 18 is connected to open loop and the D.C. output from the A.C./D.C. converter 19 is of opposite polarity to the D.C. circuit supply.

The sensors 17 of the parallel circuits 10 and 11 are located in the same vicinity and may consist of insulated wires, the resistance of the insulation of the wires varying in dependence upon changes in temperature.

When the circuits 10 and 11 are functioning correctly, i.e. with no faults, the voltage output from each A.C./D.C. converter 19 will be sufficient to energise the indicator 20 of the respective circuit thereby giving a constant visual indication of correct functioning of the circuit. If the electrical characteristics of the sensors 17 change the output of the sensor circuits 16 will change with a resultant loss in output from the A.C./D.C. converter 19. This loss in output from both A.C./D.C. converters 19 will cause the output circuit 12 to produce an output which will cause operation of the visual or audible alarm system and may effect automatic operation of fire fighting means.

If any fault occurs in any one of the circuits 10, 11 the output from the A.C./D.C. converter 19 of the faulty circuit 10 or 11 will reduce or be at zero causing the indicator 20 of the faulty circuit 10 or 11 to become inoperative, i.e. the lamp will not be energized, giving an indication that there is a fault in that circuit. This reduction or loss in output from the A.C./D.C. converter 19 of the faulty circuit will not cause the output circuit 12 to produce an output and therefore it will not cause operation of the visual or audible alarm system.

It will be appreciated that more than two parallel circuits 10, 11 can be connected to the output circuit 12.

The apparatus described with reference to the drawings has been described with reference to a fire or overheating alarm system but the invention is not limited to such systems as the apparatus may be used with any protection system where a change in electrical characteristics of a sensor is to be sensed and used to give a warning or effect a safeguarding action.

The object of the invention is to provide a detecting system which will automatically give an indication of any faults developed in the system.

Other modes of applying the principle of the invention may be employed, change being made as regards the details described, provided the features stated in any of the following claims, or the equivalent of such be employed.

I, therefore, particularly point out and distinctly claim as my invention:

1. Apparatus for detecting changes in the electrical characteristics of sensor devices comprising, in combination, an output circuit, a plurality of electrical circuits each connected to said output circuit, each of said plurality of electrical circuits comprising an AC generator, a sensor circuit serially connected to said AC generator, an AC amplifier serially connected to said sensor circuit, said sensor circuit being connectable to a sensor device whereby a change in an electrical characteristic of said sensor device will cause a change in output from said sensor circuit, an AC/DC converter having an input connected to an output of said AC amplifier and having an output for providing a DC output voltage, whereby either a change in said electrical characteristic of said sensor device to beyond a predetermined value or a fault in said electrical circuit will cause said DC output voltage at the output of said AC/DC converter to lie beyond a predetermined value, and indicator means connected to the output of said AC/DC converter, said outputs of all of said AC/DC converters being connected to said output circuit and said output circuit being arranged to provide an output signal when said DC output voltages at the outputs of all of said AC/DC converters lie beyond said predetermined value.

2. Apparatus as set forth in claim 1, wherein said output circuit comprises a relay, said relay being actuated when the DC output voltages from all of said AC/DC converters lie below a predetermined value.

3. Apparatus as set forth in claim 1, including a source of DC power connected to each of said AC amplifiers.

4. Apparatus as set forth in claim 3, wherein said source of DC power includes a battery or an AC/DC converter arranged to be connected to an AC power supply.

5. Apparatus as set forth in claim 3, wherein the polarity of said source of DC power is opposite to the polarity of the DC output voltages of said AC/DC converters.

* * * * *